United States Patent [19]

Shimoda et al.

[11] Patent Number: 4,779,507

[45] Date of Patent: Oct. 25, 1988

[54] PERCUSSIVE MUSICAL INSTRUMENT

[75] Inventors: Isao Shimoda; Sigemitsu Fujioka, both of Hamamatsu-shi, Japan

[73] Assignee: Nippon Gakki Seizo Kabushiki Kaisha, Japan

[21] Appl. No.: 78,035

[22] Filed: Jul. 27, 1987

[30] Foreign Application Priority Data

Jul. 28, 1986 [JP] Japan ..... 61-178343
Jul. 28, 1986 [JP] Japan ..... 61-178344

[51] Int. Cl.[4] ..... G10D 13/08
[52] U.S. Cl. ..... 84/402
[58] Field of Search ..... 84/402, 403, 404, 410, 84/406; 446/408, 418

[56] References Cited

U.S. PATENT DOCUMENTS 3,439,572 4/1969 Cohen ..... 84/402

*Primary Examiner*—L. T. Hix
*Assistant Examiner*—Brian W. Brown
*Attorney, Agent, or Firm*—Ostrolenk, Faber, Gerb & Soffen

[57] ABSTRACT

In construction of a percussive musical instrument such as a wood block having at least one striker head and an internal resonator chamber for resonation of vibrations generated at the striker head, at least one round striker head is arranged along at least one slit formed in communication with the resonator chamber for exact and easy generation of intended musical tones regardless of the swing mode of a stick.

15 Claims, 3 Drawing Sheets

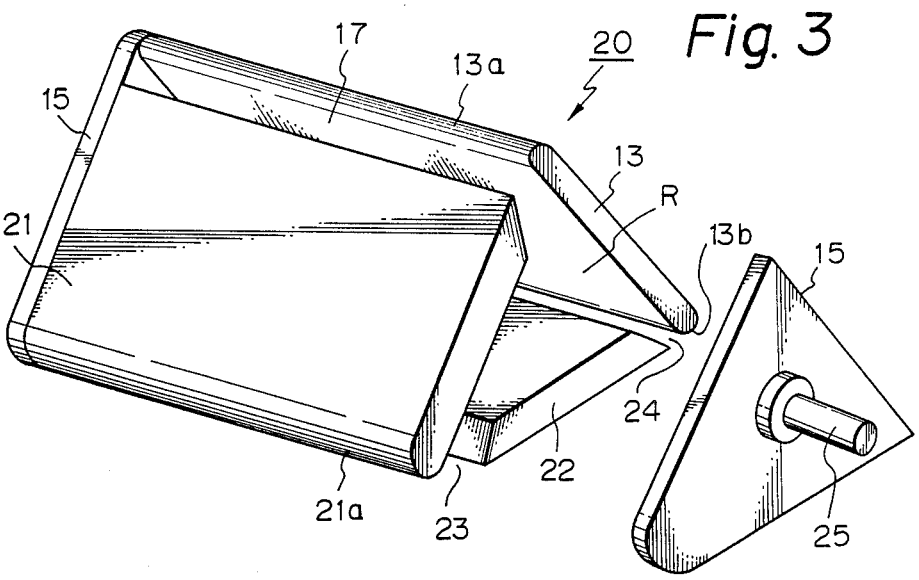
Fig. 3
Fig. 4
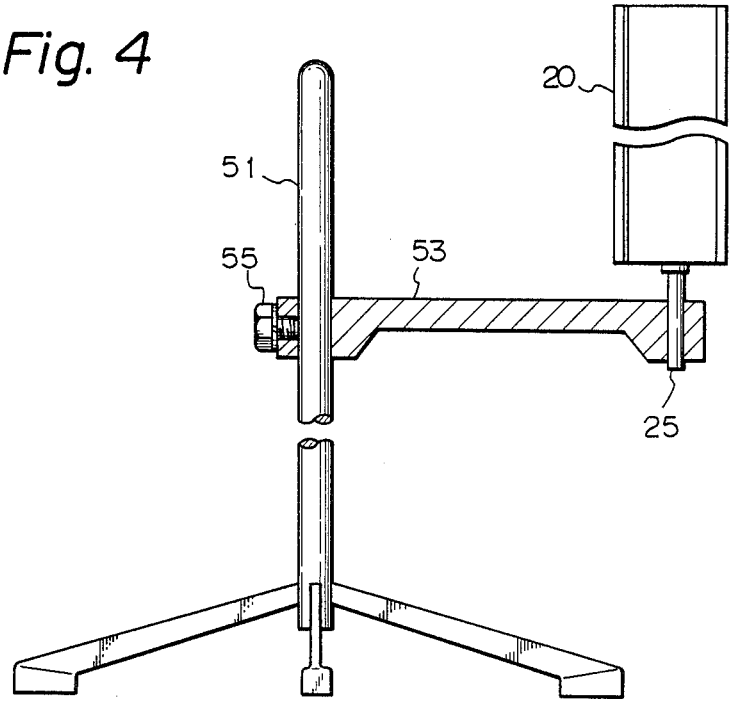

PERCUSSIVE MUSICAL INSTRUMENT

BACKGROUND OF THE INVENTION

The present invention relates to an improved percussive musical instrument and more particularly relates to an improvement in construction of a percussive musical instrument such as a wood block which has at least one striking head to be struck by a striker such as a stick and a resonator chamber for resonating vibrations generated at the striking head.

One typical conventional percussive musical instrument of the above-described type includes a rectangular main block and a pair of flat, shallow recesses formed in opposite faces of the main block and opening sideways. The recesses are covered with flat plates to form resonator chambers.

When the central section or a section close to the edge of one cover plate is struck by a stick, the cover plate vibrates. Sound waves generated by the vibration are selected and amplified in the resonator chamber for emanation of musical tones having tonal pitches and tone colors inherent to that musical instrument. Sometimes, the edge itself is struck to create a special musical effect.

To generate beautiful musical tones, it is important to optionally strike the striking head to generate optimum vibrations.

To this end, a stick is struck down on the cover plate. It is sometimes difficult however to strike exactly the intended section of the cover plate. For example, when it is intended to strike the edge of the cover plate, the central section may unexpectedly be struck. Such irregular striking causes irregular warping of the cover plate from time to time and, as a consequence, stable generation of vibrations cannot be assured. Such irregular vibrations of the cover plate tends to generate musical tones different than those intended.

In addition, when the edge of the cover plate is to be struck, the angle of the striker, i.e. the stick, with respect to the edge of the cover plate greatly influences the resulting vibration. When this angle is kept within a certain limit, the angle has no significant influence on the vibrations. When the angle exceeds this limit, however, the mode of vibration changes greatly. As a result, the intended effect cannot be obtained even when the edge is struck on purpose if the angle of striking is inadequate. It is in general very difficult for ordinary players to master the idea of this optimum angle of striking which usually differs from instrument to instrument.

SUMMARY OF THE INVENTION

It is the object of the present invention to provide a percussive musical instrument which enables a player to generate the exact musical tones intended without difficulty.

In accordance with the basic aspect of the present invention, a sound block includes a main body which internally defines an elongated resonator chamber of a substantially triangular transverse cross-sectional profile, a flat board is coupled to the main body while leaving at least one slit elongated in the longitudinal direction of the sound block in communication with the resonator chamber and the flat board has at least one round striker head extending along the slit.

BRIEF DESCRIPTION OF THE DRAWINGS

FIG. 3 is a perspective view, partly exploded, of a second embodiment of the percussive musical instrument in accordance with the present invention, FIG. 4 is a front view of one example of the manner in which the instrument shown in FIG. 3 may be mounted.

DESCRIPTION OF THE PREFERRED EMBODIMENTS

Figure 1:
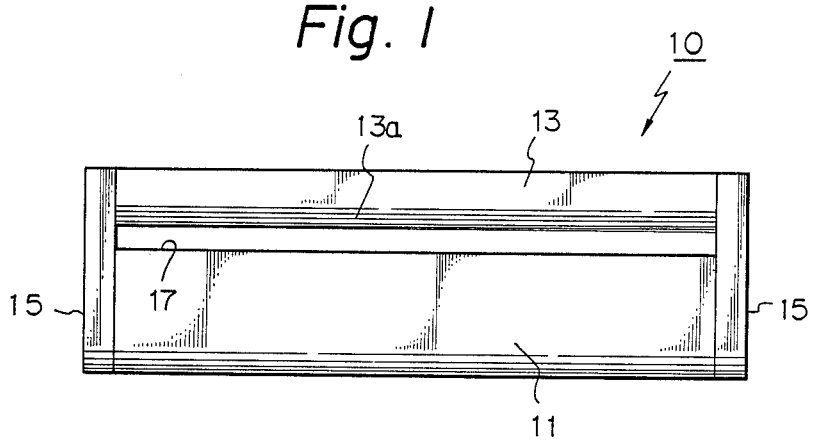
FIG. 1 is a plan view of a first embodiment of the percussive musical instrument in accordance with the present invention.
Figure 2:
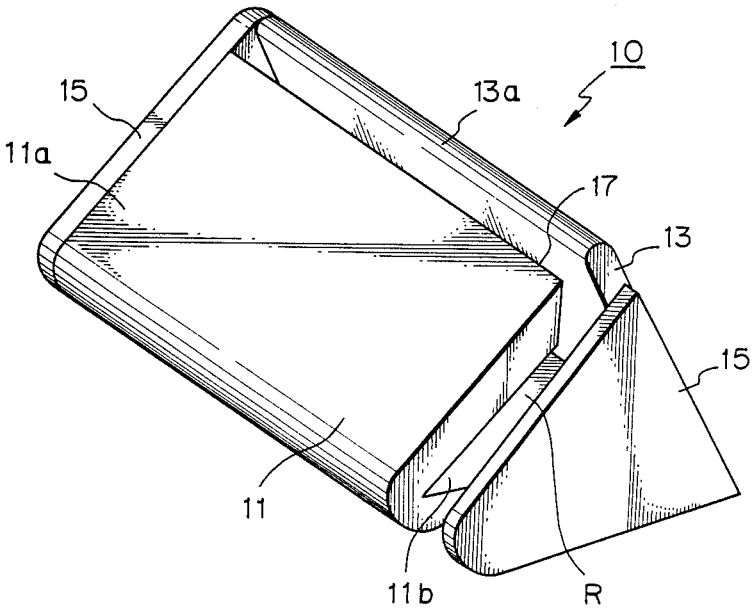
FIG. 2 is a perspective view, partly exploded for easier understanding, of the instrument shown in FIG. 1.

A first embodiment of the percussive musical instrument in accordance with the present invention is shown in FIGS. 1 and 2, in which the sound block includes a V-shaped main body which opens sideways, a pair of side boards coupled to both open longitudinal ends of the main body, and a flat plate is arranged facing the rear open end of the main body while leaving a slit.

More specifically, the V-shaped main body 11 is made up of a front wall 11*a* and a bottom wall 11*b* connected to each other at their apex. Both side openings of the main body 11 are closed by a pair of side boards (the right side board 15 being exploded to aid in describing the invention) 15 and the rear open end of the main body 11 is closed by the flat board 13 while leaving a first slit 17 extending in the longitudinal direction of the main body 11. Thus, an elongated resonator chamber R of a substantially triangular cross-sectional profile is defined by the main body 11, the side boards 15 and the flat board 13 in communication with the first slit 17. The top edge of the flat board 13 is provided with a round striker head 13*a* which extends along the first slit 17. Preferably the radius of curvature of this striker head 13*a* is equal to one-half of the thickness of the flat board 13.

When a stick is swung down towards the striker head 13*a* of the sound block 10, the stick always strikers the striker head 13*a* without any possibility of striking the central section and the section close to the edge of the flat board 13. In other words, the flat board 13 is always struck at a constant section regardless of the course of swing of the stick. There is no possibility of striking any unintended section of the flat plate 13. This assures stable generation of vibration and, as a consequence, enables generation of musical tones exactly intended by the player.

When a player stands behind the side of the flat board 13, the slit 17 is directed towards the audience. As a result musical tones emanate directly towards the audience for better transmission of the musical tones generated. This mode of emanation is quite opposite to that of the prior art.

A second embodiment of the percussive musical instrument in accordance with the present invention is shown in FIG. 3, in which the sound block 20 includes a main body made up of a pair of wall plates 21,22 arranged at a prescribed center angle relative to each other defining a second slit 23 elongated in the longitudinal direction of the sound block between them. A pair of side boards 15 are coupled to both longitudinal ends of the pair of wall plates 21,22 and a flat board 13 is arranged facing the open end of the wall plates 21,22 while leaving the first and third slits, 17 and 24 which are also elongated in the longitudinal direction of the sound block 20.

The main body is made up of front wall plate 21 and a bottom wall plate 22 arranged with a prescribed center angle relative to one another. The second slit 23 is left between the edges of the two wall plates 21 and 22 which is elongated in the longitudinal direction of the sound block. Both side openings of the main body are closed by a pair of side boards 15 (the right side board being shown exploded from the main body) and a flat board 13 is arranged facing the rear open end of the main body. The third slit 24 is defined between the edges of the bottom wall 22 and the flat board 13 which is again elongated in the longitudinal direction of the main body. Thus an elongated resonator chamber R having a substantially triangular cross-sectional profile is defined by the wall plates 21 and 22, the side boards 15 and the flat board 13 in communication with the first to third slits 17, 23 and 24. At the top and bottom edges, the flat board 13 is provided with round striker heads 13*a* and 13*b* which extend along the first and third slits 17 and 24, respectively. The front wall plate 21 is provided at the bottom edge with a round striker head 21*a* which extends along the second slit 23. As in the first embodiment, the radius of curvature of each striker head is equal to a one-half of the thickness of the associated board or plate.

With this construction of the second embodiment, musical tones of different tonal pitches can be generated by striking different striker heads. To this end, the wall plates 21,22 and the board 13 may have different thicknesses. Alternatively, the slits may be of different dimensions. In this case wall plates 21,22 and the board 13 may be formed of the same thickness for easier production. The presence of multiple slits on one sound block 20 makes performance of the instrument quite easy, in particular when the instrument is held by one hand of the player. Typically the length of the main body is in the range from 40 mm to 300 mm. One of the side boards 15 is provided with a handle 25 for holding by the player.

In addition to such manual holding, the sound block 20 may be mounted to a stand 51 via an arm 53 shown in FIG. 4. The proximal end of the arm 53 is fixed to the stand 51 by a set screw 55 whereas the distal end of the arm 53 rotatably holds the sound block 20 upright via the handle 25. To change the tonal pitch during performance, the sound block 20 is rotated about its axis by the player.

Figure 5:
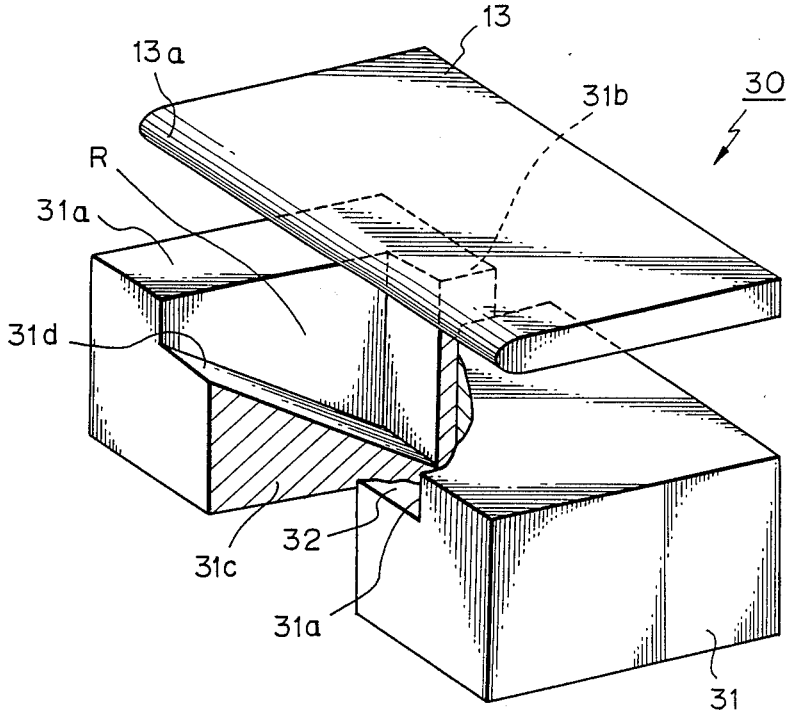
FIG. 5 is a perspective view, partly exploded, of the third embodiment of the percussive musical instrument in accordance with the present invention.

A third embodiment of the percussive musical instrument in accordance with the present invention is shown in FIG. 5, in which the sound block 30 includes a main body 31 in the shape of a rectangular prism internally defining a resonator chamber 12 which is of a substantially triangular transverse cross-sectional profile and locally opens in two adjacent faces of the main body and one of the above-described faces is closed by a flat board 13 while leaving a slit 32 in the other of the above-described adjacent faces. More specifically in FIG. 5, the main body 31 is made up of a pair of side walls 31*a*, a rear wall 31*b* and a bottom wall 31*c*. The bottom wall 31*c* has a slope on its top face which descends inwards to define a resonator chamber R of a substantially triangular transverse cross-sectional profile. The resonator chamber R locally opens at the topand front faces of the main body 31. The top face of the main body 31 is closed by a flat board 13 (shown exploded from the body 31) while leaving a slit 32 in the front face of the main body 31. The flat board 13 has a round striker head 13*a* extending along the slit 32 in communication with the resonator chamber R. Like the foregoing embodiments, the radius of curvature of the striker head is preferably one-half of the thickness of the flat board 13.

The sound block in accordance with the present invention is most generally made of woods such as Honduras rosewood, onoore kamba and padouk. It can also be made of glass fiber reinforced resin or carbon fiber reinforced resin.

We claim:

1. An improved percussive musical instrument, comprising:

a sound block including a longitudinally elongated main body which internally defines an elongated resonator chamber having a substantially triangular cross-sectional profile as viewed along a plane which is perpendicular to the longitudinal direction of said main body; and a flat board coupled to said main body while leaving a slit elongated in said longitudinal direction and in communication with said resonator chamber.

2. An improved percussive musical instrument as claimed in claim 1, in which said flat board is provided with a round striker head extending along an axis generally parallel to said longitudinal direction.

3. An improved percussive musical instrument as claimed in claim 1, in which:

said sound block includes a V-shaped main body opening sideways at longitudinal ends thereof and a pair of side boards coupled to both open longitudinal ends of said main body; and said flat board is arranged facing a rear open end of said main body.

4. An improved percussive musical instrument as claimed in claim 2 in which the radius of curvature of said striker head is equal to one half of the thickness of said flat board.

5. An improved percussive musical instrument as claimed in claim 1, in which:

said sound block includes a main body made up of a pair of wall plates arranged at a predetermined angle relative to one another while leaving a second slit elongated in the longitudinal direction of said sound block, and a pair of side boards coupled to both longitudinal ends of said pair of wall plates;

said flat board is arranged facing an open end of said resonator chamber while leaving said first slit and a third slit therebetween, said first and third slits being elongated in the longitudinal direction of said sound block.

6. An improved percussive musical instrument as claimed in claim 5, in which said flat board is provided with a striker head whose radius of curvature is equal to one-half of the thickness of said flat board.

7. An improved percussive musical instrument as claimed in claim 5, in which one of said wall plates is provided with a striker head whose radius of curvature is equal to one-half of the thickness of said one of said wall plates.

8. An improved percussive musical instrument as claimed in claim 1, in which:

said sound block includes a main body in the shape of a rectangular prism and internally defining a resonator chamber which is of a substantially triangular cross-sectional profile and which locally opens in two adjacent faces of said main body; and one of said faces is closed by said flat board while leaving said slit in the other of said adjacent faces.

9. An improved percussive musical instrument as claimed in claim 8, in which said flat board includes a striker head whose radius of curvature is equal to one-half of the thickness of said flat board.

10. An improved percussive musical instrument comprising:

a sound block including a V-shaped main body which internally defines an elongated resonator chamber having a substantially triangular cross-sectional profile, said main body opening sideways at longitudinal ends thereof and a pair of side walls coupled to both open longitudinal ends of said main body; and a flat board coupled to said main body and facing a rear open end of said main body while leaving a slit elongated in said longitudinal direction in communication with said resonator chamber.

11. An improved percussive musical instrument, comprising:

a sound block including a main body which internally defines an elongated resonator chamber having a substantially triangular cross-sectional profile; and a flat board coupled to said main body while leaving a slit elongated in a longitudinal direction of said sound block in communication with said resonator chamber, said flat board being provided with a round striker head extending along an axis generally parallel to said longitudinal direction and having a radius of curvature which is equal to one-half the thickness of said flat board.

12. An improved percussive musical instrument, comprising:

(A) a sound block including:

(1) a main body made up of a pair of wall plates arranged at a predetermined angle relative to one another while leaving a center slit elongated in the longitudinal direction of said sound block and a pair of side walls coupled to both longitudinal ends of said pair of wall plates, said pair of wall plates internally defining an elongated resonator chamber having a substantially triangular cross-sectional prifile; and a flat board coupled to said main body and facing the open end of said resonator chamber while leaving second and third slits therebetween, said second and third slits being elongated in a longitudinal direction of said sound block.

13. An improved percussive musical instrument as claimed in claim 12, in which said flat board is provided with a striker head whose radius of curvature is equal to one-half of the thickness of said flat board.

14. An improved percussive musical instrument as claimed in claim 12, in which one of said wall plates is provided with a striker head whose radius of curvature is equal to one-half of the thickness of said one of said wall plates.

15. An improved percussive musical instrument, comprising:

a sound block including a main body in the shape of rectangular prism and internally defining a resonator chamber which is of substantially triangular cross-sectional profile and wich locally opens in two adjacent faces of said main body; and a flat board coupled to said main body while leaving a slit which is elongated in said longitudinal direction and in communication with said resonator chamber, said flat board closing one of said faces of said main body while leaving said slit in another of said adjacent faces, said flat board including a striker head whose radius of curvature is equal to one-half of the thickness of said flat board.

* * * * *